US005290975A

United States Patent [19]

Mizuno et al.

[11] Patent Number: 5,290,975

[45] Date of Patent: Mar. 1, 1994

[54] DOOR CONTROL AND DATA DISPLAY SYSTEM

[75] Inventors: Masamoto Mizuno; Masanori Tawada; Terumi Hirabayashi; Toshiyuki Kodera, all of Aichi, Japan

[73] Assignee: Mitsubishi Denki Kabushiki Kaisha, Tokyo, Japan

[21] Appl. No.: 737,253

[22] Filed: Jul. 29, 1991

[51] Int. Cl.[5] ..... B66B 1/14

[52] U.S. Cl. ..... 187/103; 187/133

[58] Field of Search ..... 187/133, 103, 104

[56] References Cited

U.S. PATENT DOCUMENTS

| | | | |
|---|---|---|---|
| 4,363,381 | 12/1982 | Bittar | 187/127 |
| 4,568,909 | 2/1986 | Whynacht | 340/21 |
| 4,750,591 | 6/1988 | Coste et al. | 187/130 |
| 4,779,708 | 10/1988 | Sasao et al. | 187/119 |
| 4,930,604 | 6/1990 | Schienda et al. | 187/133 |
| 5,010,472 | 4/1991 | Yoneda et al. | 364/148 |

FOREIGN PATENT DOCUMENTS

| | | | |
|---|---|---|---|
| 1-92191 | 7/1989 | Japan . | |
| 3-172293 | 10/1991 | Japan | 187/103 |

*Primary Examiner*—Steven L. Stephan
*Assistant Examiner*—Robert Nappi
*Attorney, Agent, or Firm*—Leydig, Voit & Mayer

[57] ABSTRACT

An elevator controlling device includes hoist controller, disposed in a mechanical room, for controlling hoist; door controller, disposed in an elevator cage, for controlling the opening and closing of an elevator door; information exchanger between the hoist controller and the door controller; data setting unit for setting predetermined data to the door controller using the hoist controller; and a data display unit for displaying the contents of the data. The data setting unit sets data such as a central processing unit number, a start address of a memory to be read, and a number of bytes in the memory required for reading data, to the door controller being made up of a plurality of central processing units, and the data display unit displays the contents at addresses of the memory. The data setting unit and the data display unit may be assembled into elevator operation supervising unit connected to the hoist controller through a telephone line.

1 Claim, 8 Drawing Sheets

DOOR CONTROL AND DATA DISPLAY SYSTEM

BACKGROUND OF THE INVENTION

The present invention relates to an elevator controlling device, and more particularly, to an elevator controlling device which can verify, e.g., the abnormality of a door controller that controls the opening/closing of an elevator door, at a hoist controller.

FIG. 6 is a system diagram showing the general construction of an elevator to which a conventional elevator controlling device is applied.

In FIG. 6, reference numeral 1 designates a mechanical room in a building in which an elevator is installed; numeral 2 represents an elevator cage; and numeral 3 is a counterweight for balancing the elevator cage 2. Numeral 4 represents an elevator door; and 5 represents an elevator door controller for controlling the opening/-closing of the elevator door 4, the controller 5 being disposed on the elevator cage 2; a data is represented by numeral 6 cable for transmitting various data; numeral 7 represents a hoist controller including an inverter and the like; while numeral 8 is a motor for driving the hoist. An encoder for measuring the speed of rotation of the motor 8 is given by numeral 9, the encoder 9 also detects the position of the elevator cage which is decelerated by a brake 10 , numeral 11 represents a hoist for ascending/descending the elevator cage 2, the hoist 11 being coupled to the motor 8 through the brake 10; a rope for connecting the elevator cage 2 and the counterweight 3 through the hoist 11; is given by numeral 12. Numeral 13 represents a deviating wheel for deviating the ascending/descending position of the counterweight 3 from the ascending/descending position of the cage 2.

In this elevator, such components as the hoist controller 7, the hoist 11 and the deviation wheel 13 are installed in the mechanical room 1. The hoist controller 7 in the mechanical room 1 performs an adaptive feedback control of the motor 8 and the brake 10, and controls the driving of the hoist 11 so that the ascending-/descending operation of the elevator cage 2 can be controlled.

An opening/closing mechanism of the elevator door 4 will now be described.

FIG. 7 is a system diagram showing the construction of an elevator door to which a conventional elevator controlling device is applied.

In FIG. 7, reference numeral 14 designates a motor for opening/closing the elevator door 4. An encoder for measuring the speed of rotation of the motor 14; is given by numeral 15. Numeral 16 represents a pulley which is rotated by the motor 4 and numeral 17 represents a belt for transmitting the rotating force of the pulley 16. Numerals 18*a* and 18*b* represent pulleys which run in parallel over the elevator door 4 and numeral 19 represents a belt which moves between the two pulleys 18*a*, 18*b*. Hanger rollers for hanging the elevator door 4 are given by numeral 20. The door controller 5 is connected to the hoist controller 7 through the data cable 6.

In the thus constructed elevator door, the door controller 5 provides an adaptive feedback control to the motor 14 and, as a result, the belt 19 is moved the elevator door 4 is opened and closed at a predetermined speed.

The conventional door controller 5 is made up of analog circuits such as shown in FIG. 8.

FIG. 8 is a block diagram showing interconnections between the door controller 5 and the hoist controller 7, this controller 5 of the conventional elevator controlling device being formed of analog circuits.

In FIG. 8, reference numeral 5*a* designates a motor controller consisting of analog circuits. Numeral 21 represents volumes for adjusting the outputs of the motor controller 5*a*, these volumes 21, when operated, serving to adjust speed patterns and the like so that the speed of opening/closing the elevator door 4 can be adjusted. A central processing unit (CPU) for the hoist controller 7; is given by numeral 24. Numeral 25 represents an inverter for controlling the driving the motor 8. Numeral 26 represents a ROM for storing predetermined speed control programs and the like for the elevator cage 2 and numeral 27, a RAM for storing data and the like, an input/output (I/O) interface is given by numeral 28, this I/O interface and the data cable 6 serving to exchange informations between the hoist controller 7 and the door controller 5. Numeral 27 represents an interface and numeral 30 represents a keyboard display which allows data entry and data display and which is connected through the interface 29.

In the thus constructed elevator controlling device, door speed adjustments, various door operations, and the operation of some other types of doors having link mechanisms or the like not shown can be effected by operating the volumes 21 of the door controller 5.

As a result of extensive use of microcomputers in recent years, some door controllers 5 include an inverter which is controlled by a microcomputer.

FIG. 9 is a block diagram showing interconnections between a hoist controller 7 and a door controller 5*b* of a conventional elevator controlling device, each controller being made up of a microcomputer. In FIG. 9, same reference numerals and symbols as those in FIG. 8 designate same or like parts and components in FIG. 8.

In FIG. 9, reference numeral 23 designates a serial transmission interface for the hoist controller 7; 31, a CPU for the door controller 5*b*; and 32, a ROM for storing predetermined speed control programs and the like for the elevator cage 2. Numeral 33 represents, a RAM for storing data and the like. A serial transmission interface for intercommunicating data with the hoist controller 7 by serial transmission is given by numeral 28 inverter for controlling the driving of a motor 14. Numeral 36 represents an interface and 37 represents a maintenance keyboard display having functions of data entry and data display, the keyboard display being connected through the interface 36.

In the thus constructed elevator controlling device, the maintenance keyboard display 37 is operated to modify the content of the memory for the door controller 5*b*, so that door speed adjustments and the like can be made. The elevator controlling device of this type displays the content of the memory for the door controller 5*b* on the keyboard display 37, allowing the respective data setting conditions to be verified.

Other conventional elevator controlling devices include those disclosed in Japanese Patent Unexamined Publication No. Hei. 1-92191 and Japanese Patent Application No. Hei. 1-306715. The feature of the former device is that an elevator door is opened and closed properly by increasing the drive torque of a door motor with increasing loads of driving the elevator door, a feature of the latter device is that specific constants Of an elevator door are set from a mechanical room. Since these disclosures are not relevant to the above-described related art, their descriptions will be omitted.

The conventional elevator controlling device whose door controller 5 is made up of analog circuits must make door speed adjustments and the like by operating the volumes 21 of the door controller 5 every time such adjustments are to be made. The elevator controlling device whose door controller 5b consists of a microcomputer must modify and verify the contents of the memory for the door controller 5b by operating the keyboard display 37. In addition, the elevator controlling devices of these types require that an operator position himself on a top of the elevator cage 2 since the door controllers 5, 5b are located on the top of the elevator cage 2. For this reason, an elevator controlling device which requires no such dangerous operation has been demanded.

SUMMARY OF THE INVENTION

The invention has been made in view of the above circumstances. Accordingly, an object of the invention is to provide an elevator controlling device which allows an operator to modify and verify the content of a memory for a door controller that controls the opening/closing of an elevator door without getting him or her on the top of an elevator cage.

According to a first aspect of the invention, an elevator controlling device includes: hoist controlling means, disposed in a mechanical room 1, for controlling a hoist 11; door controlling means, disposed on an elevator cage 2, for controlling the opening and closing of an elevator door 4; means for mutually exchanging informations between the hoist controlling means and the door controlling means; means for setting predetermined data to the door controlling means while using the hoist controlling means; and means for displaying data, the data being the content of the data setting means.

According to a second aspect of the invention, an elevator controlling device includes: the same hoist controlling means; the same door controlling means, the same information exchange means, the same data setting means, and the same data display means as those of the first aspect of the invention, and the data setting means sets, to a door controlling means made up of a plurality of central processing units, data such as a central processing unit number, a start address of a memory to be read, and a number of bytes in the memory required for reading the data, while the data display means displays a content at an address of the memory.

According to a third aspect of the invention, an elevator controlling device includes: the same hoist controlling means; the same door controlling means, the same information exchange means, the same data setting means, and the same data display means as those of the first and second aspects of the invention, and the data setting means and the data display means are incorporated into elevator operation supervising means which is connected to the hoist controlling means through a telephone line.

In the first aspect of the invention, the driving of the hoist 11 is controlled by the hoist controlling means disposed in the mechanical room 1 to ascend/descend the elevator cage 2, while the opening/closing of the elevator door 4 is controlled by the door controlling means disposed on the elevator cage 2. Predetermined door opening/closing control data are sent to the door controlling means from the hoist controlling means through the information exchange means and the contents of the sent data are displayed on the data display means. Therefore, the operator can modify and verify the content of the memory for the door controlling means using the hoist controlling means in the mechanical room 1 without climbing on the top of the elevator cage 2.

In the second aspect of the invention, the data setting means sends to the door controlling means consisting of a plurality of central processing units, such as a central processing unit number, a start address of a memory to be read, and a number of bytes in the memory required for reading the data, while the data display means displays a content at the address of the memory. Therefore, similarly to the first aspect of the invention, the operator can modify and verify the content of the memory for the door controlling means using the hoist controlling means in the mechanical room 1 without climbing on the top of the elevator cage 2. In addition, upon occurrence of an abnormality at the door controlling means, various data at the instance of the door controlling means having detected the occurrence of the such abnormality can be stored at a predetermined memory address, thereby allowing the hoist controlling means to access the specific memory address of the door controlling means.

In the third aspect of the invention, the data setting means and the data display means are incorporated into the elevator operation supervising means which is connected to the hoist controlling means through a telephone line. This allows the elevator operation supervising means to function as the data setting means and the data display means, and thus the abnormal conditions of the door controlling means can be checked by the elevator operation supervising means which is located at a remote place. Therefore, similarly to the first or second aspect of the invention, the operator can modify and verify the content of the memory for the door controlling means without climbing on the top of the elevator cage 2.

DETAILED DESCRIPTION OF THE PREFERRED EMBODIMENTS

Preferred embodiments of the invention will now be described.

Figure 1:
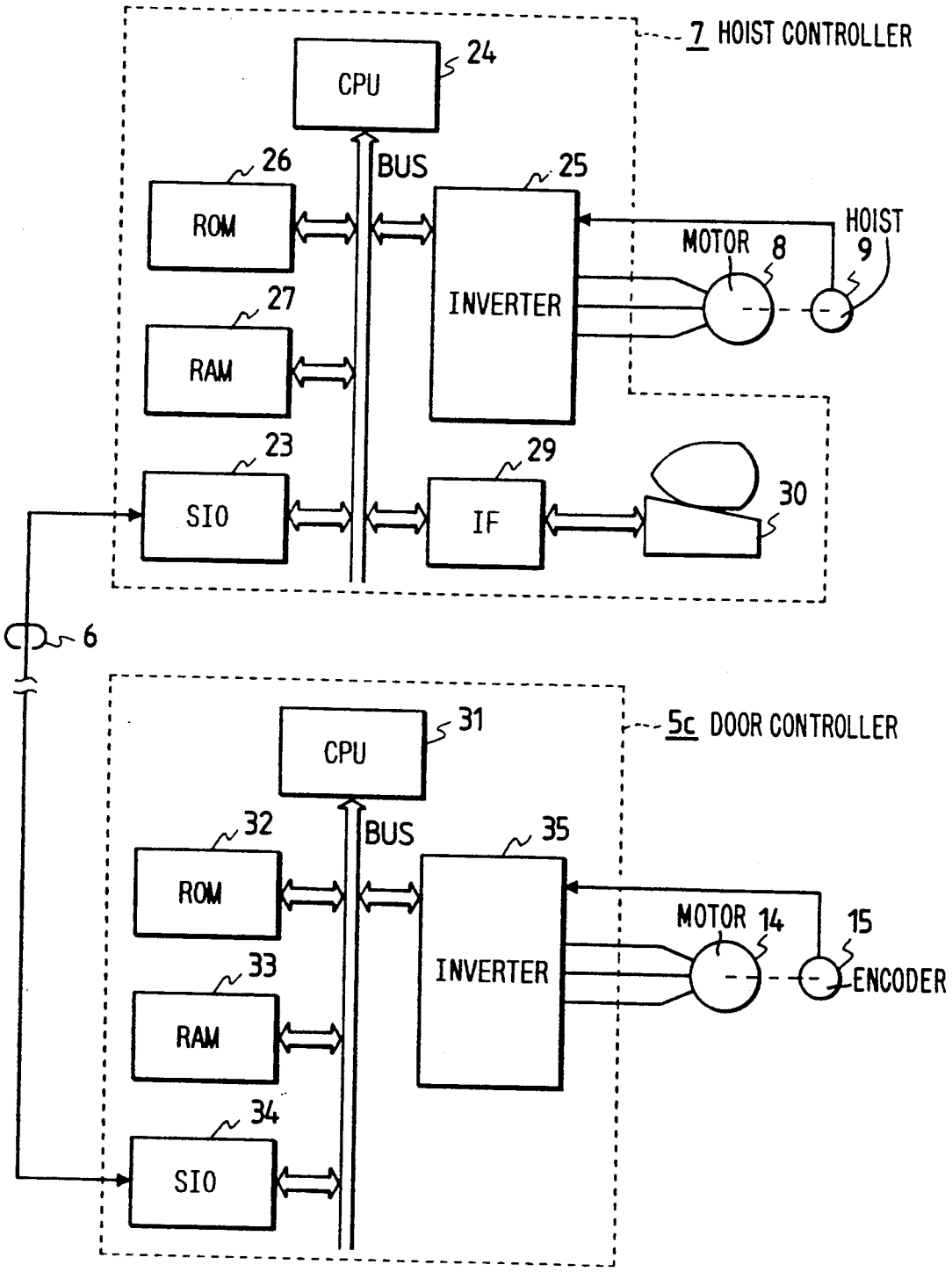
FIG. 1 is a block diagram showing a main portion of an elevator controlling device, which is an embodiment of the invention.
Figure 6:
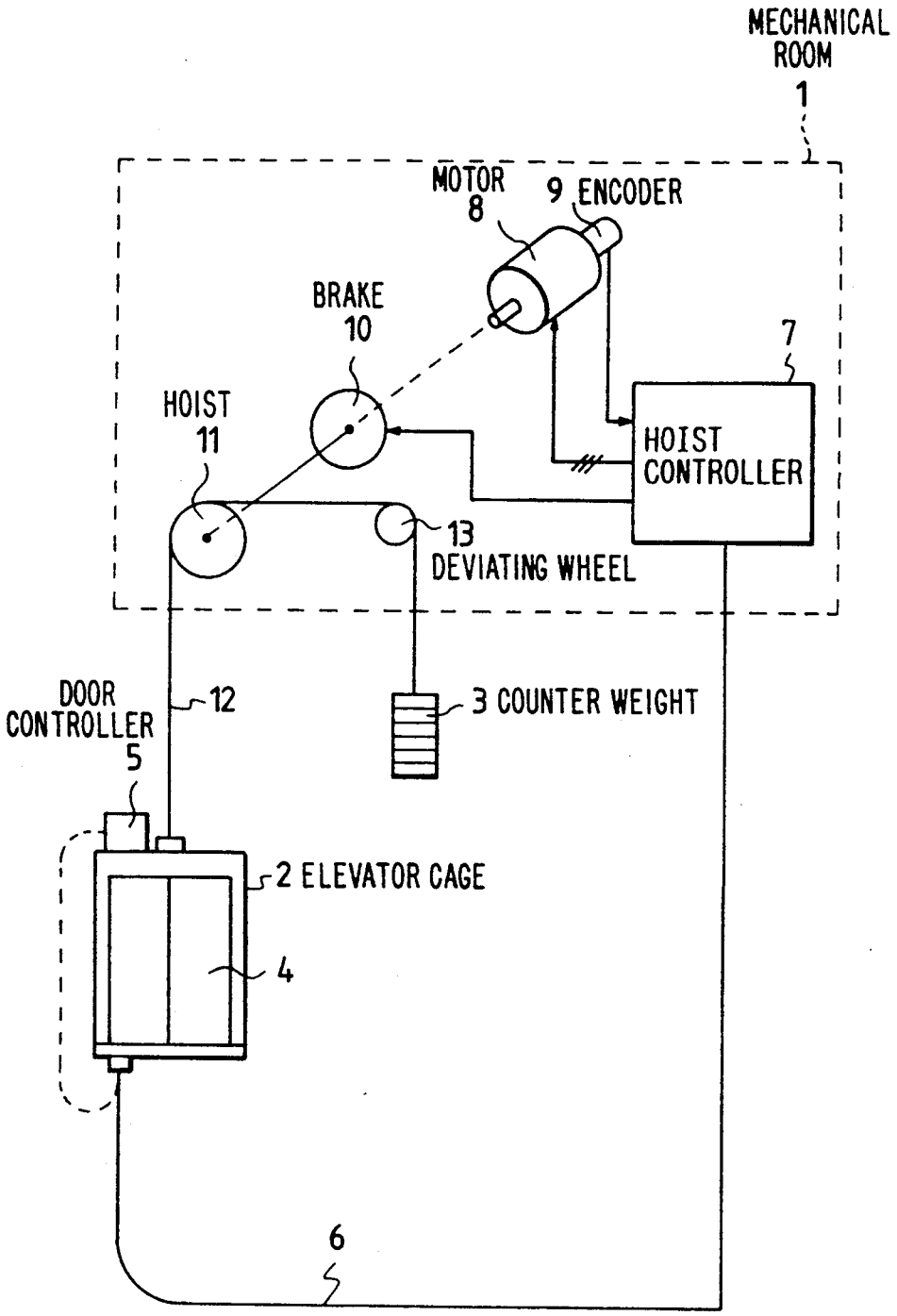
FIG. 6 is a system diagram showing a general elevator system to which both the embodiment of the invention and a conventional elevator controlling device are applied.
Figure 7:
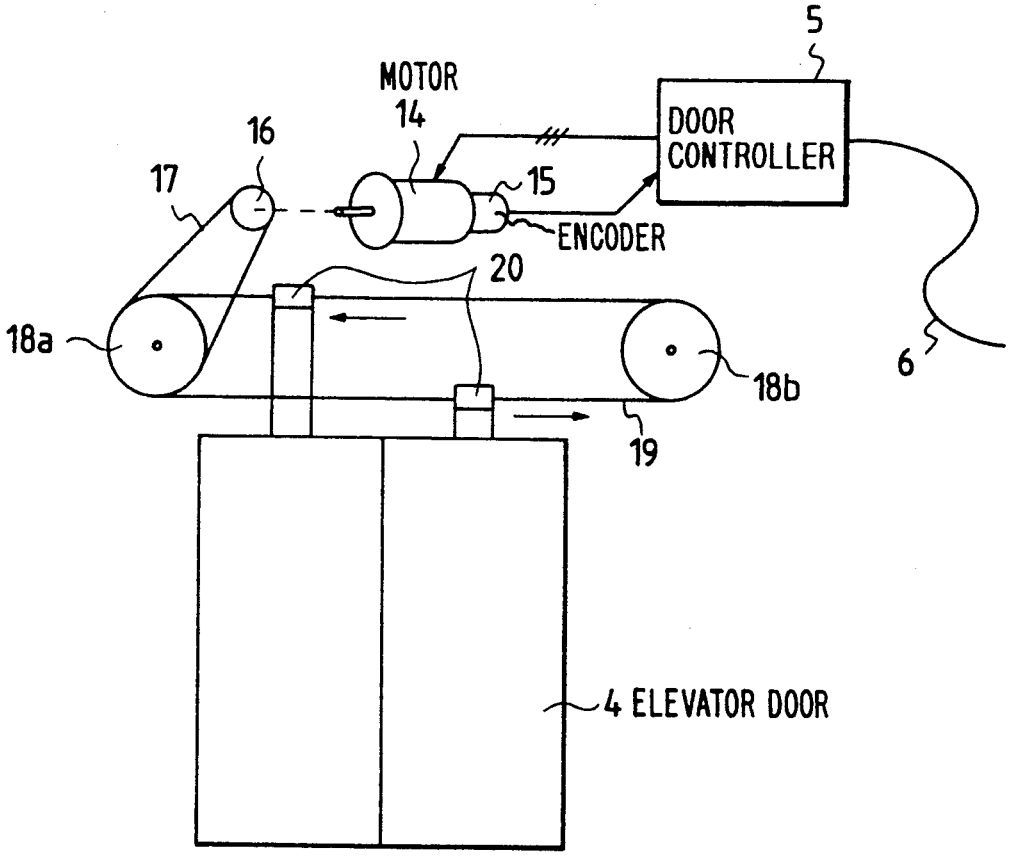
FIG. 7 is a system diagram showing the construction of an elevator door to which the embodiment of the invention and the conventional elevator controlling devices are applied.
Figure 8:
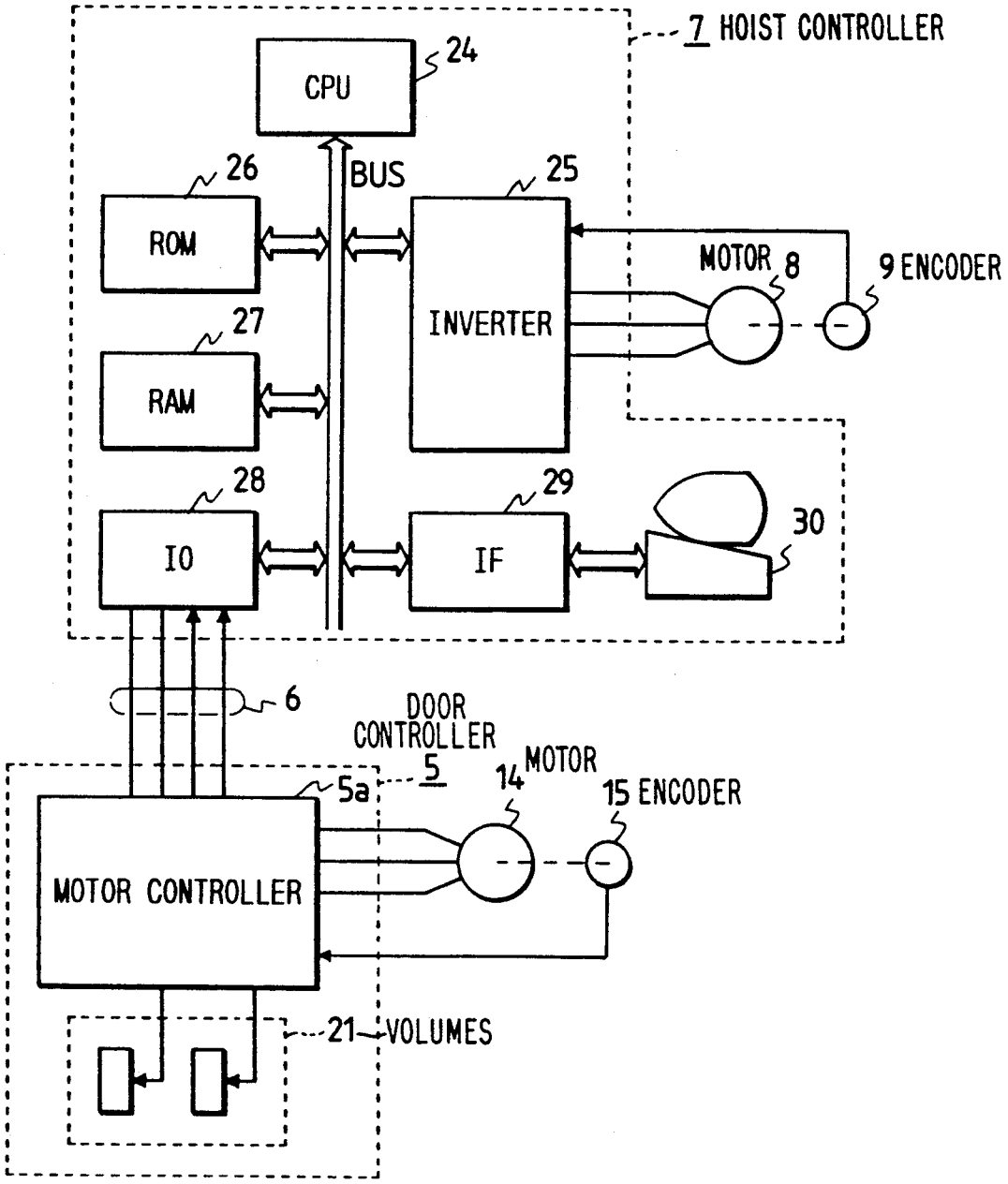
FIG. 8 PRIOR ART
FIG. 8 is a block diagram showing interconnections between a door controller and a hoist controller of a conventional elevator controlling device, the door controller being made up of analog circuits.

FIG. 1 is a block diagram showing a main portion of an elevator controlling device, which is a first embodiment of the invention. This figure shows interconnections between a door controller 5c and a hoist controller 7, each of which is controlled by a microcomputer. FIGS. 6 and 7 will commonly be referenced for this embodiment. In FIG. 1, same reference numerals and symbols as in the conventional examples designate same or like parts and components in the conventional examples. Since the ascending/descending operation of an elevator cage 2 o and the opening/closing operation of an elevator door 4 have already been described in the conventional examples, the description of these operations will be omitted.

Figure 9:
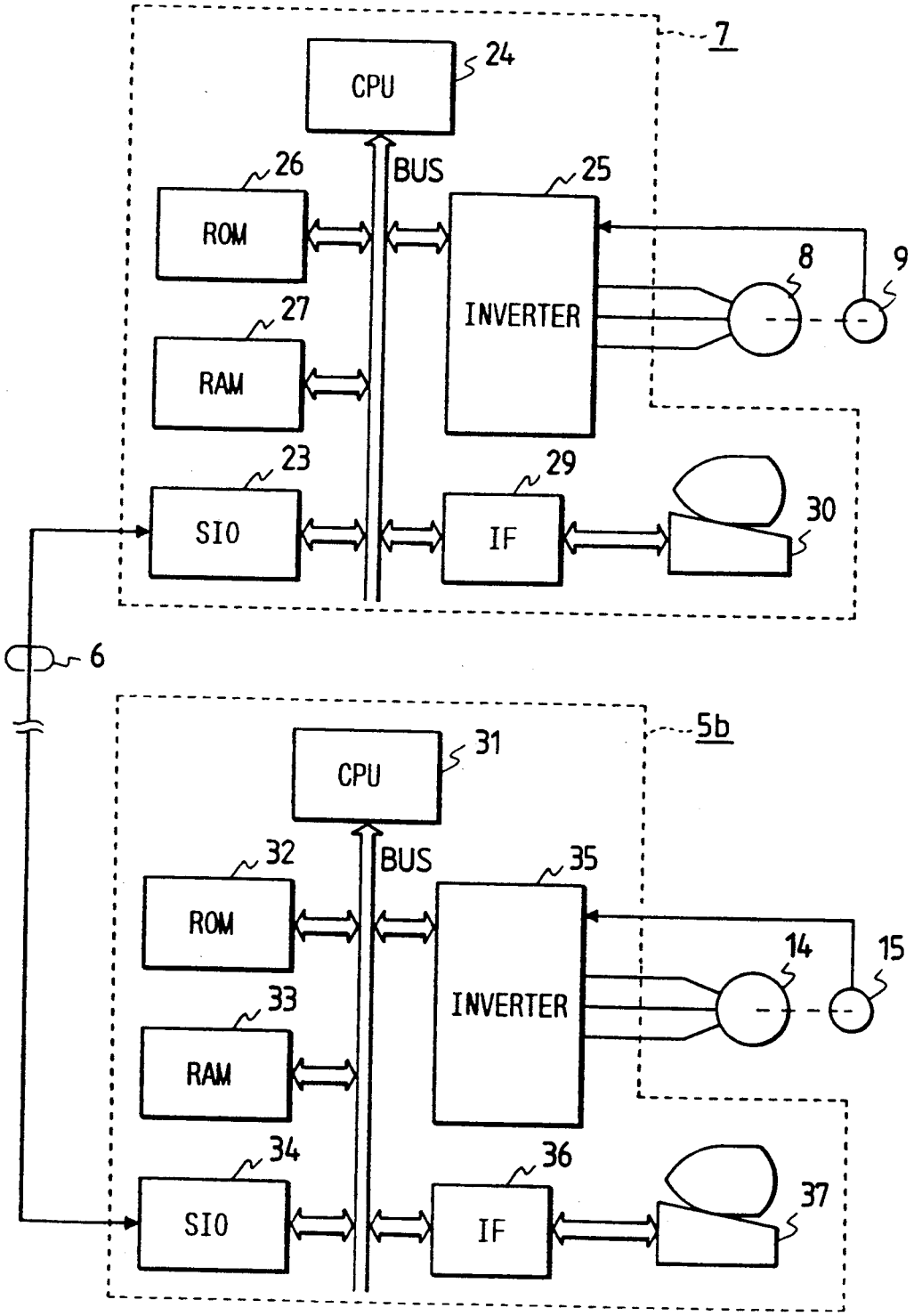
FIG. 9 PRIOR ART
FIG. 9 is a block diagram showing interconnections between a door controller and a hoist controller of a conventional elevator controlling device, both controllers being made up of microcomputers.

In FIG. 1, reference numeral 5c designates a door controller, in which the interface 36 and the keyboard display 37 are removed from the door controller 5b shown in FIG. 9, which uses a microcomputer. Other than the door controller 5c, the construction of the first embodiment is the same as that shown in FIG. 9. Also in this embodiment, a serial transmission interface 23 of a hoist controller 7 and a serial transmission interface 34 of the door controller 5c are connected through a data cable 6.

Figure 2:
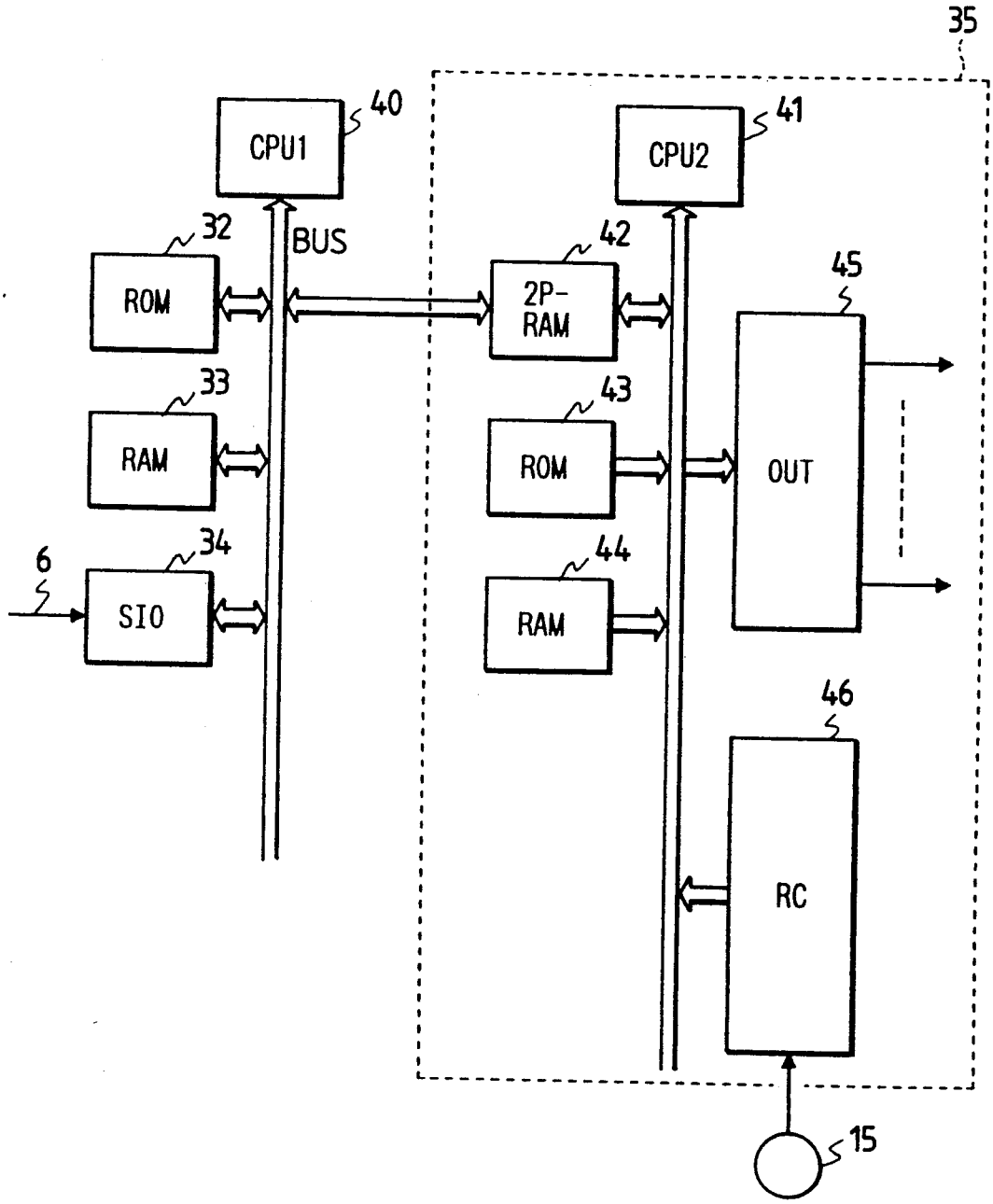
FIG. 2 is a block diagram showing a door controller of the elevator controlling device shown in FIG. 1.

FIG. 2 is a block diagram showing a door controller of an elevator controlling device, which is the embodiment of the invention. This door controller includes a plurality of microcomputers, and its inverter 35 is formed of one of the microcomputers. In FIG. 2, same reference numerals and symbols as in FIG. 1 designate same or like parts and components in FIG. 1.

In FIG. 2, reference numeral 40 designates a CPU1, which is a central processing unit for serial data transmission; 41, a CPU2, which is a central processing unit for controlling the inverter 35; 42, a two-port RAM for transmitting data to and from the CPU1 40 for serial transmission and the CPU2 41 for inverter control; 43, a ROM for storing predetermined inverter control programs and the like; 44, a RAM for storing inverter control data and the like; 45, an output interface for outputting signals for driving a motor 14; and 46, a reversible counter for measuring the speed of the motor 14 by feedback pulse trains from an encoder 15.

Figure 3:
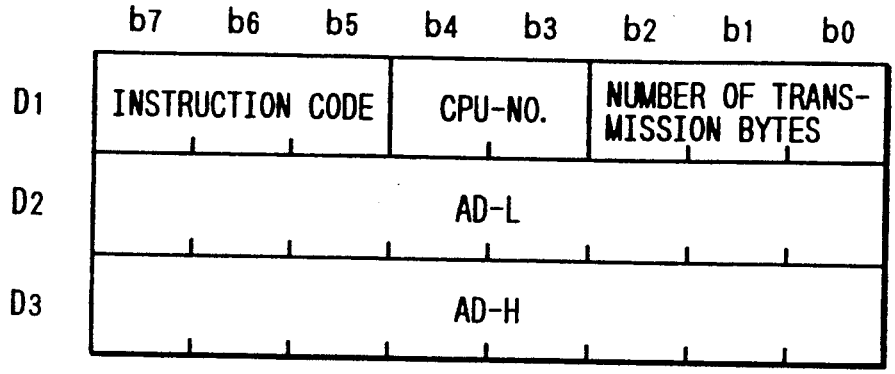
FIG. 3 is a diagram showing a data format of a transmission code to be transmitted to the door controller from a hoist controller.

In the thus constructed elevator controlling device, the keyboard display 30 of the hoist controller 7 shown in FIG. 1 is operated to enter various data and cause the CPU 24 to perform operations, so that transmission codes having such contents as shown in FIG. 3 are generated. These transmission codes are transmitted from the hoist controller 7 to the door controller 5c through the data cable 6.

Here, the transmission code will be described.

FIG. 3 is a diagram showing a data format of the transmission code to be transmitted from the hoist controller to the door controller.

In FIG. 3, an area D1 contains data such as an instruction code that indicates a transmission instruction, a CPU-NO that is the number of a CPU of the door controller 5c, and the number of transmission bytes from a start address indicated by data in areas D2, D3. The area D2 contains lower bytes AD-L of the start address of the transmission data and the area D3 contains higher bytes AD-H of the start address of the transmission data. The instruction specified by the instruction code is to read the content of the memory for the CPU of the door controller 5c specified by the CPU-NO from the start address indicated in the areas D2, D3 by the number of bytes specified by the number of transmission bytes and to transmit the read data.

Figure 4:
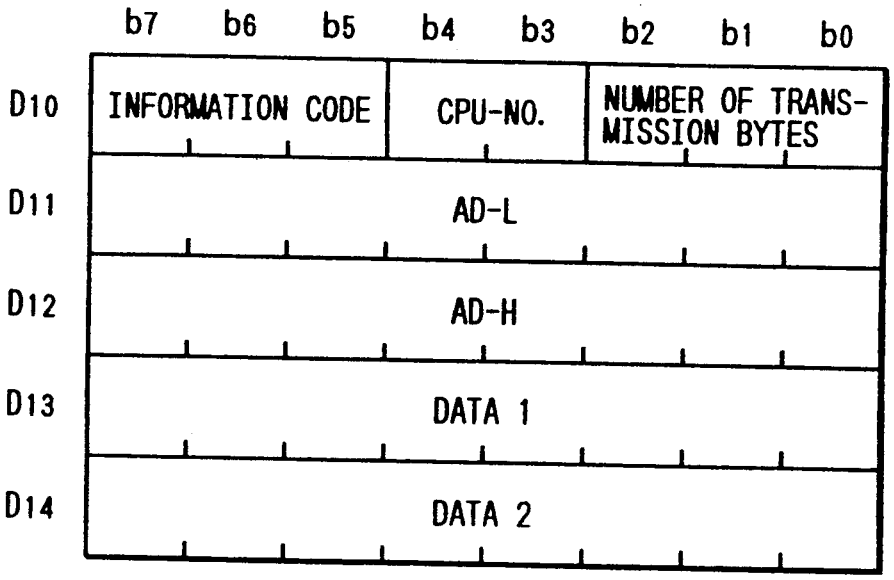
FIG. 4 is a diagram showing a data format of a return code to be returned from the door controller to the hoist controller.

The transmission code with such contents is transmitted from the serial transmission interface 23 of the hoist controller 7 to the door controller 5c through the data cable 6. Upon reception of the transmitted data, the CPU1 40 of the door controller 5c transmits the data as follows in accordance with the instruction. If the CPU-NO specifies the CPU1 40, the CPU1 40 reads predetermined data from the RAM 33 and has return data transmitted to the hoist controller 7 through the serial transmission interface 34 based on a format such as shown in FIG. 4. If the CPU-NO specifies the CPU2 41, the CPU1 41 reads predetermined data from the RAM 44 of the microcomputer for the inverter 35 via the two-port RAM 42 and has return data transmitted to the hoist controller 7 through the two-port RAM 42, the CPU1 40, and the serial transmission interface 34.

Here, the return code will be described.

FIG. 4 is a diagram showing a data format of the return code to be returned from the door controller to the hoist controller.

In FIG. 4, an area D10 contains such data as an information code that is a memory read data of the door controller 5c, a CPU-NO that is the number of a CPU controlling the data to be read, and the number of transmission bytes of the read data. An area D11 contains lower bytes AD-L of a start address of the transmission data and an area D12 contains higher bytes AD-H of the start address of the transmission data. An area D13 contains data at the address specified by the data in the D11, D12, and an area D14 contains data at an address next to the address specified by the data in the areas D11, D12.

Accordingly, by connecting the hoist controller 7 to the door controller 5c through a serial transmission system as described above, the keyboard display 30 of the hoist controller 7 installed in the mechanical room 1 in the building displays the content of an abnormality of the door controller 5c upon occurrence of the abnormality. More specifically, data such as the motor speed, the door position, the current reference, and the actual current at the instance the door controller 5c has recognized an abnormality are stored at a predetermined memory address, and the memory address of the door controller 5c is accessed thereafter by the hoist controller 7 in the mechanical room 1 in the building, accordingly the content of the abnormality and the conditions at the time the abnormality has occurred can be verified. In addition, the use of the serial transmission system to transmit signals between the hoist controller 7 and the door controller 5c in this embodiment permits the transmission circuits to be simple in structure.

As described above, the elevator controlling device according to the embodiment includes: the hoist controlling means which is disposed in the mechanical room 1 and made up of the motor 8 and the hoist controller 7 for controlling the driving of the hoist 11; the door controlling means which is disposed on the elevator cage 2 and made up of the motor 14 and the door controller 5c for controlling the opening/closing the elevator door 4; the information exchange means which is made up of the serial transmission interfaces 23, 34 and the data cable 6 for exchanging informations between the hoist controlling means and the door controlling means; the data setting means which is made up of the keyboard display 30 for setting predetermined data to the door controlling means using the hoist controlling means; and the data display means which is made up of the keyboard display 30 for displaying the contents of the set data.

The driving of the hoist 11 is controlled by the hoist controlling means disposed in the mechanical room 1 to ascend/descend the elevator cage 2, while the opening/closing of the elevator door 4 is controlled by the door controlling means disposed on the elevator cage 2. The predetermined door opening/closing control data is set to the door controlling means by the hoist controlling means through the information exchange means, and the content of the set data is displayed on the data display means.

Therefore, to modify and verify the content of the memory for the door controlling means, the operator does not have to get on the top of the elevator cage 2 any longer as with the conventional examples; he or she can do it using the hoist controller 7 disposed in the mechanical room 1 in the building. As a result, the operability and safety at the time of maintenance and inspection can be improved significantly.

Further, the predetermined data set to the door controlling means made up of the motor 14 and the door controller 5c with a plurality of CPUs (CPU1, CPU2) using the hoist controlling means made up of the motor 8 and the hoist controller 7 as in the embodiment include such data as a CPU number (CPU-NO), a start address of a memory to be read (the start address indicated in the areas D2 and D3), and the number of bytes in the memory required for reading the data as shown in FIG. 3. The content of the set data displayed by the data display means made up of the keyboard display 30 is the data at the memory address (the data contained in the areas D13 and D14 in FIG. 4).

Accordingly, when an abnormality occurs at the door controller 5c, the motor speed, the door position, the current reference, the actual current, and like data at that instance are stored in the above memory address. And by accessing the predetermined memory address of the door controller 5c by the hoist controller 7 located in the mechanical room 1 in the building thereafter, the content of the abnormality, the conditions at the time the abnormality has occurred, and the like can be verified. As a result, the operability and safety at the time of maintenance and inspection can be improved significantly.

Another embodiment of the invention will be described next.

Figure 5:
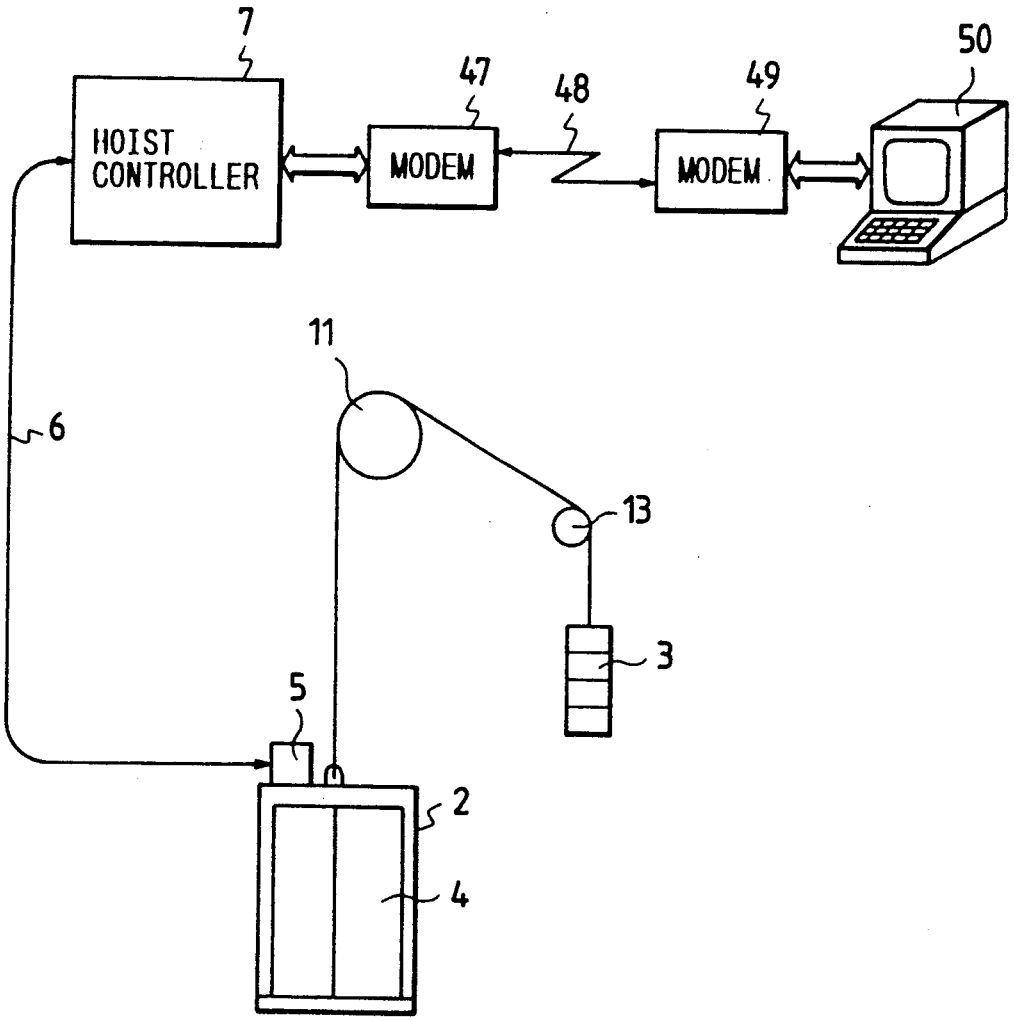
FIG. 5 is a system diagram showing an elevator controlling device using a telephone line.

FIG. 5 is a system diagram showing an elevator controlling device using a telephone line.

In FIG. 5, reference numeral 47 designates a modem for modulating transmission signals and demodulating return signals. Numeral 48 represents, an ordinary telephone line and numeral 49 represents, a modem for modulating transmission signals and demodulating return signals. A computer for supervising the operation of an elevator is given by numeral 50.

The thus constructed elevator controlling device has a hoist controller 7 connected to the modem 47, which modem is connected to the computer equipped with the modem 49 via the telephone line 48. The computer 50 is located at a separate place. The hoist controller 7 and a door controller 5 are connected through a data cable 6, and the information is transmitted by the serial transmission system.

Thus, the elevator controlling device according to this embodiment includes: the hoist controlling means, the door controlling means and the information exchange means as in the first embodiment, and causes the computer 50 to serve as both the data setting means and the data display means. Therefore, abnormal conditions at the door controller 5 can be verified, etc., using the computer 50 located in a separate plate.

Specifically, in the elevator controlling device according to this embodiment, the data setting means and the data display means are incorporated into the computer 50 (elevator operation supervising means) which is connected to the hoist controller 7 via the telephone line 48 and which performs the supervision of the operation and the like of the elevator located in a remote place.

Therefore, as in the first embodiment, the operator can modify and verify the content of the memory for the door controlling means without climbing on the top of the elevator cage 2, thereby allowing the operability and safety at the time of maintenance and inspection to be improved.

While a serial transmission system is employed as the information exchange means between the hoist controlling means and the door controlling means in the above embodiments, a parallel transmission system may also be used. Parallel transmission is less economical compared to serial transmission, but it provides higher efficiency in transmission. Further, while the elevator controlling device whose door controller 5 has no interface 36 and the keyboard display 37 has been described in the above embodiments, these components may be provided to the door controller 5 as redundant components. In such a case, the content of the memory for the door controller 5 can be modified and verified by directly operating the keyboard display 37, thereby allowing the elevator controlling device to be well provided for an emergency.

What is claimed is:

1. An elevator controlling device, comprising:

door controlling means for controlling opening and closing of an elevator door comprising a CPU interconnected with an inverter, a first ROM, a first RAM and a serial transmission interface via a first system bus, the inverter including a CPU interconnected with a second ROM, a second RAM, a reversible counter and a two port RAM via a second system bus, the two port RAM being electrically connected to the first system bus and said door controlling means being secured to an elevator cage;

hoist controlling means for controlling a hoist disposed in a mechanical room;

means for setting data for said door controlling means connected to said hoist controlling means;

means for transmitting the data for said door controlling means through said hoist controlling means said door controlling means; and display means for displaying contents of the data set by the means for setting data, said display means being connected to said hoist controlling means.

* * * * *

UNITED STATES PATENT AND TRADEMARK OFFICE

CERTIFICATE OF CORRECTION

PATENT NO. : 5,290,975

DATED : March 1, 1994

INVENTOR(S) : Mizuno et al.

It is certified that error appears in the above-indentified patent and that said Letters Patent is hereby corrected as shown below: Title Page, insert

--[30] Foreign Application Priority Data
July 30, 1990 [JP] JAPAN.....2-201676--

Signed and Sealed this

Fourth Day of October, 1994

Bruce Lehman

*Attest:*

BRUCE LEHMAN

*Attesting Officer*

*Commissioner of Patents and Trademarks*